United States Patent [19]

Young et al.

[11] Patent Number: 4,986,445

[45] Date of Patent: Jan. 22, 1991

[54] GASOLINE DISPENSER WITH VALVE CONTROL THROUGH AN AIR GAP

[75] Inventors: Harold R. Young, Kernersville; John S. McSpadden, Greensboro; James R. McMordie, Winston Salem; Leon B. Smith, Greensboro, all of N.C.

[73] Assignee: Gilbarco Inc., Greensboro, N.C.

[21] Appl. No.: 445,466

[22] Filed: Dec. 4, 1989

[51] Int. Cl.[5] ..... B67D 5/16

[52] U.S. Cl. ..... 222/71; 137/560; 251/129.15; 222/504

[58] Field of Search ..... 222/1, 26, 71, 37, 189, 222/504, 542, 129, 130; 137/560, 561 R; 251/129.15, 129.17

[56] References Cited

U.S. PATENT DOCUMENTS

| | | | |
|---|---|---|---|
| 2,573,112 | 10/1951 | Schneckenburger | 194/3 |
| 3,254,795 | 6/1966 | Mackie | 222/20 |
| 3,773,219 | 11/1973 | Irie et al. | 222/2 |
| 3,871,503 | 3/1975 | Greenwood | 194/13 |
| 3,935,435 | 1/1976 | Greenwood | 235/151.34 |
| 4,162,027 | 7/1979 | Howard et al. | 222/23 |
| 4,198,374 | 4/1980 | Arnaud et al. | 422/111 |
| 4,576,312 | 3/1986 | Swick, Jr. | 222/27 |
| 4,934,565 | 6/1990 | Heisey et al. | 222/504 |

*Primary Examiner*—Michael S. Huppert
*Assistant Examiner*—Kenneth Bomberg
*Attorney, Agent, or Firm*—Kenneth Watov

[57] ABSTRACT

A gasoline dispenser system includes a housing with a first enclosure providing a safe area for mounting electrical apparatus, a second enclosure providing a hazardous area for mounting fuel carrying apparatus, an air gap vapor barrier separating the first and second enclosures, at least one bifurcated electromechanical valve for controlling gasoline flow, having a solenoid winding mounted within the first enclosure, and a valve body mounted within the second enclosure, with a control rod connected from the solenoid winding, through the air gap, to a plunger or control device within the valve body, and with an elastomeric seal about the control rod for secondary sealing where it enters the second enclosure, for substantially preventing gasoline fumes from escaping from the second enclosure into the air gap.

27 Claims, 7 Drawing Sheets

GASOLINE DISPENSER WITH VALVE CONTROL THROUGH AN AIR GAP

FIELD OF THE INVENTION

The field of the present invention relates generally to fuel dispensers, and more specifically to gasoline dispensers including hazardous classified and safe unclassified zones for housing various apparatus of the dispenser.

RELATED APPLICATIONS

This application is related to Ser. No. 07/445,384, filed Dec. 4, 1989, entitled "VAPOR RECOVERY SYSTEM FOR FUEL DISPENSER", and assigned to the same assignee as the present invention.

BACKGROUND OF THE INVENTION

In conventional gasoline dispenser designs, electrical devices are integrated within hazardous areas of the dispenser including components that contain fuel. In such typical prior dispensers, electrical devices are either enclosed in explosion proof housings or isolated through use of intrinsically safe circuitry, in order to protect against the hazard of a spark igniting fuel vapors. Also, several known dispenser designs provide for placing the mechanical apparatus (flow meter) of a fuel meter in a hazardous or classified zone, and its associated electrical apparatus (such as an electrical pulser) in an unclassified zone. The two zones are separated by a vapor barrier provided by an air gap, and mechanical linkages are used to interconnect the mechanical and electrical portions of the fuel meter apparatus. As discussed below, there are many prior designs to safeguard gasoline dispensers against electrical ignition of gasoline vapors.

Mackie, U.S. Pat. No. 3,254,795, teaches in a fuel dispenser the elimination of conventional mechanical motion transmitting couplers, for permitting electrical switch contacts to be hermetically sealed as a safeguard against ignition of gasoline vapors, and so forth.

Schneckenburger, U.S. Pat. No. 2,573,112, teaches in a coin operated dispensing pump, the application of a pedestal mounted housing away from the gasoline dispenser housing, wherein the pedestal housing encloses all of the coin operated mechanisms for operating the gasoline pump. Electrical connections between the coin operated mechanisms and the electrical mechanisms of the gasoline pump are connected via wires contained in enclosed conduits.

Irie, U.S. Pat. No. 3,773,219, discloses a fuel dispensing system providing for preset control. The preset mechanisms are located in a remote control system away from the fuel handling mechanisms, permitting a reduction in the number of electrical wires required near the fuel handling portions of the dispenser, in turn permitting an explosion-proof housing to be inexpensively constructed for whatever wires may remain in the vicinity of the fuel handling area.

Greenwood, U.S. Pat. No. 3,871,505, discloses a gasoline dispenser including isolated compartments for a gasoline flow path, and for various electronic mechanisms of the dispenser. As indicated in column 2, lines 54 through 61, an upper compartment 11 for electronic mechanisms is isolated from a lower compartment 10 by a bottom plate within the upper compartment 11. A fiberoptic system is used to transmit signals from the fuel handling compartment 10 to the electronic compartment 11.

In Howard et al., U.S. Pat. No. 4,162,027, a device for transferring information from the liquid handling area of a gasoline dispenser to a remote location includes electro-optic means for converting mechanically recorded or generated information into electrical signals, which are passed through a barrier containing spark preventing resistors, into a remote location outside of the hazardous zone.

Swick, U.S. Pat. No. 4,576,312, discloses a multiple product dispenser including a plurality of hoses. The enclosure or housing for the dispenser is segmented into a number of individual enclosures isolated from one another but joined together to form the overall housing. A light housing 60 is shown at the uppermost portion of the overall housing. The light housing 60 is duplicated on the opposite side of the dispenser in mirror image. As shown in FIG. 5, located between the light housings 60 is a trough 59 which houses conduits 12 for delivering gasoline to the dispenser hoses 26. As described in column 5, lines 34 through 40, the configuration is such that the light housings 60 are spaced a short distance away from trough 59 to provide an air gap therebetween, for preventing volatile fumes from entering the light housings 60, where they may possibly be ignited by the electrical apparatus contained within the light housings 60. There is no communication, be it mechanical or electrical, between the light housings 60 and the juxtaposed trough 59.

SUMMARY OF THE INVENTION

An object of the invention is to provide an improved gasoline dispenser.

Another object of the invention is to provide in a gasoline dispenser the packaging of electrical devices for the hydraulic module in a safe or unclassified zone, and the packaging of associated hazardous fuel carrying apparatus in a classified zone, with an air gap serving as a vapor barrier separating the two zones.

Another object of the invention is to provide an improved gasoline dispenser system including packaging of a solenoid winding for a fuel control valve in an unclassified safe zone, and mechanically linking the solenoid to an associated valve body packaged within a classified or hazardous zone, with the two zones being separated by a vapor barrier, including either a solid partition, air gap, or combination of a solid vapor partition and air gap.

Yet another object of the invention is to provide an improved gasoline dispenser for eliminating the requirement for explosion proof housings or intrinsically safe circuits for electrical equipment associated therewith.

Yet another embodiment of the invention is to provide an improved gasoline dispenser including a split hydraulic module assembly, with a valve body integral with a flow meter in a hazardous or classified zone, mechanically linked through a barrier to a safe or unclassified zone in which an associated pulser for the flow meter, and a valve coil or valve solenoid are located.

With these objects in mind, in one embodiment of the invention, a gasoline dispenser system includes the mounting of electrical valve control mechanisms in a safe or unclassified zone, with mechanical linkage means being connected from the valve control mechanisms through an air gap to associated valve bodies included in a hydraulic assembly located in a hazardous or classified zone through which fuel is transported.

DETAILED DESCRIPTION OF THE DRAWINGS

Various preferred embodiments of the present invention will be described below with reference to the accompanying drawings, in which like items are indicated by the same reference designations, and in which.

DETAILED DESCRIPTION OF THE PREFERRED EMBODIMENT OF THE INVENTION

Figure 1:
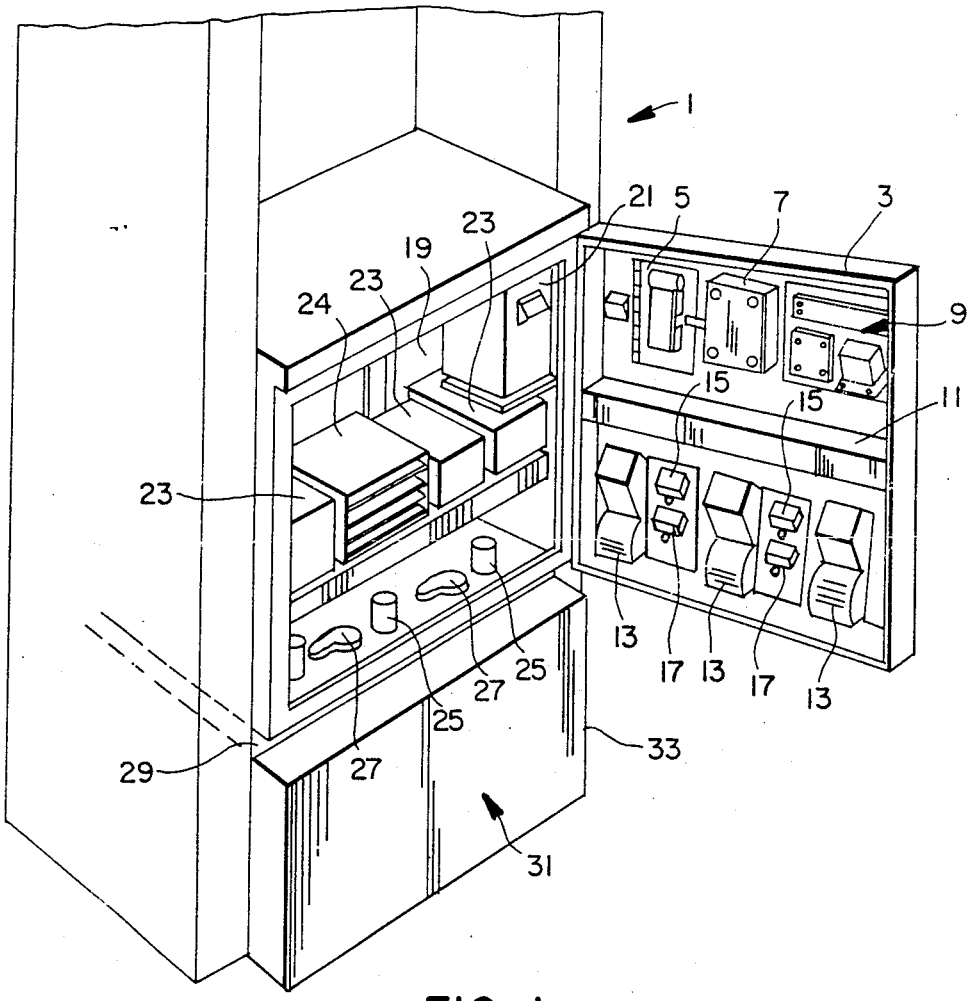
FIG. 1 is a partial pictorial drawing showing a gasoline dispenser housing and packaging arrangement including one embodiment of the invention including a proportional valve.

A portion of an enclosure for a gasoline dispenser incorporating one embodiment of the invention is illustrated in FIG. 1. In this example, the dispenser 1 includes an access door 3 on which is mounted a ticket printer 5, a main display 7, a credit card reader and indicator assembly 9, a light trough 11, nozzle boots 13, price per unit indicator modules 15, and switches 17. An upper compartment 19 includes a note accepter unit 21, power supplies and an electronics module 23, solenoid windings 25, pulsers 27, card cage 24, and other necessary equipment modules that are not shown for the sake of simplicity. An air gap 29 is provided between the upper compartment 19 and a lower compartment 31 having an access door or panel 33. The lower compartment 31 is included for housing the fuel carrying apparatus associated with the hydraulic module for the gasoline dispenser, as will be described in greater detail below. Note that the area included within the upper cabinet 19 represents a safe unclassified area for electrical devices. The lower compartment 31 provides a classified or hazardous area.

Figure 2:
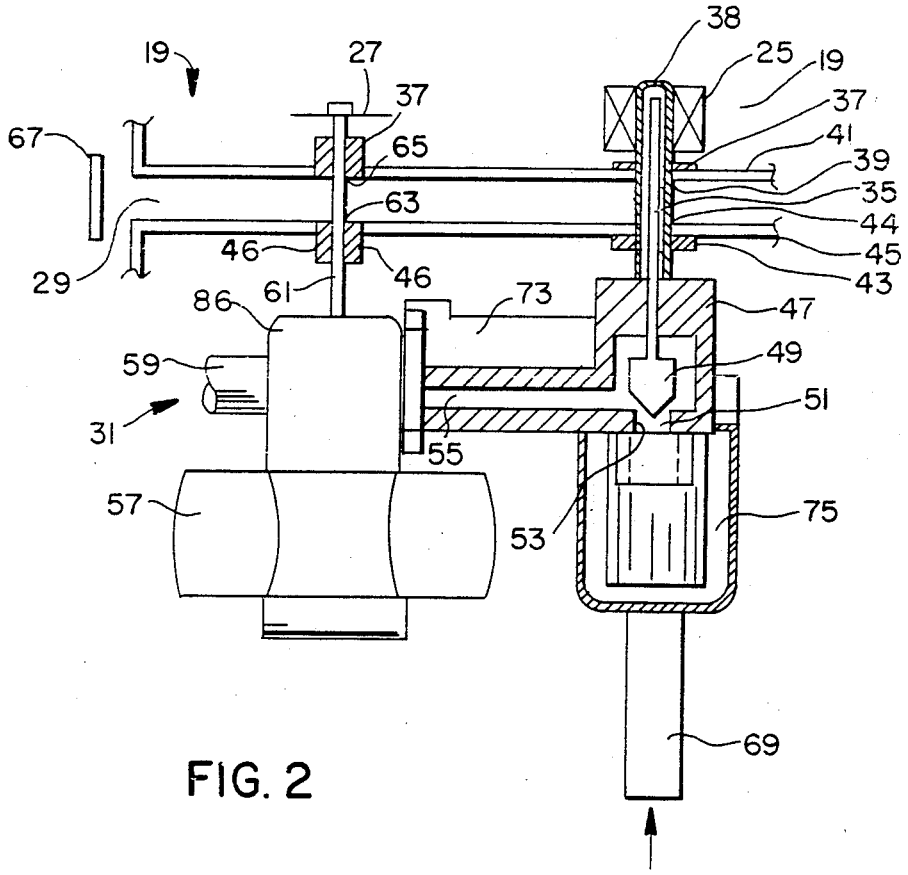
FIG. 2 is a simplified and partial sectional view of one embodiment of the invention.

In FIG. 2, a simplified fragmentary and partial cross-section of one embodiment of the invention is shown. A solenoid winding 25 is mounted by appropriate means (not shown) in an unclassified or safe zone, the interior of enclosure or cabinet 19, for example. Also mounted in the enclosure 19 is a pulser 27, as previously illustrated. In this example, assume that the solenoid winding 25 is associated with a proportional solenoid valve, although many other types of electrical valves may be used. These include hydraulically operated two-stage pilot valves, rotary valves, and so forth. A control rod or push rod 35 is enclosed within the containment core 38, which is surrounded by the solenoid winding 25. The containment core 38 and control rod 35 exit through a sealing bushing or member 37, and a hole 39 through the wall 41 of enclosure 19, and enter through a hole 44 and sealing bushing 43 into the lower enclosure or hazardous area 31. The hole 44 is through the wall 45 of the lower enclosure 31. The other end of the containment core 38 is inserted into a valve body 47, and the control rod 35 is rigidly attached to a valve plunger 49. The containment core 38 encapsulates the control rod 35, thus eliminating the requirement for fluid seals. Sealing bushings 43 and 37 are vapor seals. The valve body 47 also includes an inlet passageway 51, a valve orifice and seat 53, and an outlet passageway 55. In the manner shown, in this embodiment of the invention, the electrical portions of the valve, namely the solenoid winding 25 is located in the unclassified or the safe zone of upper enclosure 19.

The hydraulic portion of a fuel volume meter, herein designated as flow meter 57, is mounted adjacent the valve body 47, and has an input port (not shown) coupled to the outlet passage 55 of valve body 47. The flow meter 57 also has an outlet port 59, and a rotatable pulser rod 61 having one end rigidly connected to an optical encoding pulser device 27. The rod 61 extends through hole 63 in the lower enclosure wall 45, and through hole 65 in the upper enclosure wall 41. A sealing bushing 46 seals the pulser rod 61 as it exists from the lower enclosure 31, and a sealing bushing 37 seals pulser rod 61 as it enters the interior or the upper enclosure 19. In addition, the bushing 37 provides a close fit between the shaft 61 and the wall 41 to prevent molten metal passage into the air gap in the event of a short circuit or transformer meltdown.

The air gap 29 provides isolation between the upper enclosure 19 and lower enclosure 31. A grill 67 (screening, for example) covers the end of the air gap 29 opening to the atmosphere. Since gasoline fumes are heavier than air, any fumes which rise into the air gap will fall out onto the open sides of air gap 29, and evaporate out of the air gap 29 into the atmosphere before being able to enter enclosure 19. The sealing bushings or members 46 act as a secondary barrier, for substantially preventing the escape of gasoline fumes or liquid from the lower enclosure 31 into the air gap 29. Similarly, the sealing bushings or members 37 in the upper enclosure 19 substantially prevent any fumes or gasoline from entering into the interior of the upper enclosure 19. The bushing or members 37 also prevent sparks and/or hot material within the enclosure 19 from escaping into the air gap where hazardous fuel vapor may be present.

In operation of the embodiment of the invention shown in FIG. 2, when gasoline is to be dispensed via a hose and nozzle (not shown) connected to the outlet port 59 of flow meter 57, electrical current is applied to the solenoid coil 25 for lifting solenoid rod 35 to move the piston 49 away from the valve seat 53, for permitting gasoline to flow from the inlet passage 51, through the valve seat and orifice 53, the outlet passageway 55, into flow meter 57. As the fuel passes through the flow meter 57, the flow meter 57 operates to rotate the pulser rod 61, in turn causing rotation and alternate electrical switching within the pulser 27, for providing electrical pulses indicative of the volume of fuel flowing through the flow meter 57 during a dispensing cycle. Fuel flows from the flow meter 57 via the outlet port 59 into the hose and nozzle combination (not shown), for dispensing the gasoline from the nozzle into a receiving tank (not shown). In this manner, any electrical arcing associated with the operation of the electrical devices associated with the hydraulic module are contained within the safe or unclassified zone with an enclosure 19, and only mechanical energy transfers are made through the air gap 29 into the classified or hazardous zone of the lower enclosure 31.

Figure 3:
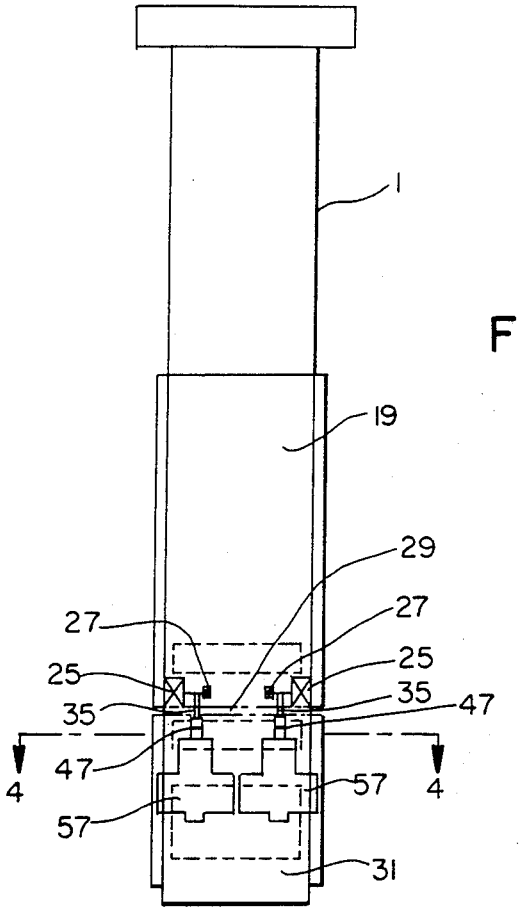
FIG. 3 shows a side elevational view of the housing of a typical gasoline dispenser system, with elements of the present invention shown in phantom for one embodiment of the invention.
Figure 4:
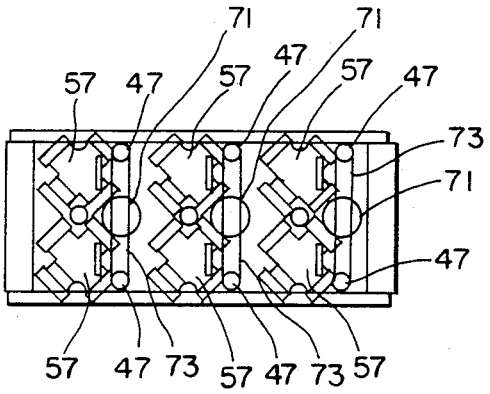
FIG. 4 shows a cross-sectional view along 4—4 of FIG. 3, for showing the top view of a hydraulic assembly for one embodiment of the invention.

In FIG. 3, an end view of a gasoline dispenser housing 1 is shown, having an upper enclosure 19, and a lower enclosure 31. As shown in phantom, in this example a pair of juxtaposed fuel meters are mounted adjacent the front and back portions of the dispenser housing 1. Also, a pair of pulsers 27, and a pair of solenoid coils 25 are mounted within the upper enclosure 19, with one of each pair of solenoid windings 25, and pulsers 27, being associated with one of the flow meters 57 proximate the end of the housing 31, with mechanical connections therebetween as previously described. In this example, assume that the dispenser housing 1 is for a gasoline dispenser including six nozzles, and associated hoses. In such a dispenser, the top cutaway view shown in FIG. 4 (taken along section 4—4 of FIG. 3), illustrates three pairs of flow meters 57 and valve bodies 47, with each pair having an associated filter 71 and manifold 73, as will be described in greater detail below. Each flow meter 57 and valve body 47 pair is associated with an individual dispenser hose and nozzle combination of the gasoline dispenser, in this example. Accordingly, in this example the mechanical elements of the hydraulic module are divided into three sub-assemblies. Each sub-assembly includes two flow meters 57, and two associated valve bodies 47, respectively, with a common filter 71 connected to the valve bodies via a manifold assembly 73.

Figure 5:
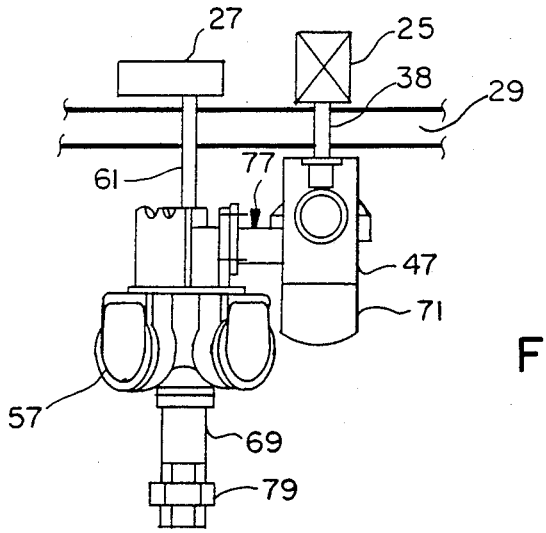
FIG. 5 is a cutaway pictorial end view of one embodiment of the invention.
Figure 6:
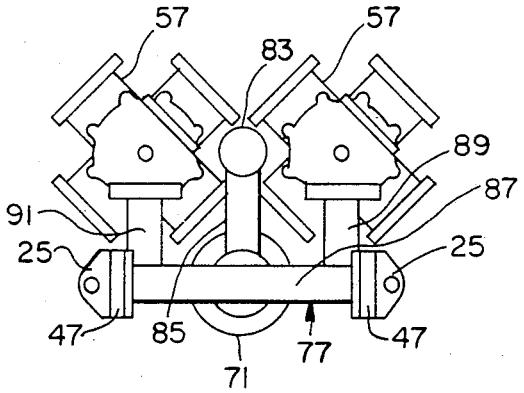
FIG. 6 is a partial cutaway top view of substantially the hydraulic portion of FIG. 5 rotated 90°.

In FIG. 5, a cutaway view shows the front view of a subassembly module including two flow meters 57, their associated pulsers 27, solenoid windings or valve coils 25, common filter 71, and manifold 77. In this view, only one flow meter 57, and its associated pulser 27, manifold 77, solenoid winding 25, and filter 71, is shown. Also shown is a fuel inlet coupling 79, inlet pipe 69, for coupling at one end to the inlet port 97 (see FIG. 8) for the common manifold 77. In FIG. 6, a top view of a portion of the hydraulic sub-assembly module, and a portion of the electrical apparatus associated therewith is shown. In this example, the manifold 77 receives fuel or gasoline under pressure at its inlet end 83, passes the fuel through a feedpipe 85 to the filter 71, and delivers the fuel via feedline or main passageway 87 to the valve bodies 47. Note that the feedline 87 receives filtered fuel from filter 71 at the center of the feedline 87, for delivery to the valve bodies 47. Also, fuel discharged from outlets of the valve bodies 47 is delivered via passageways (not shown) within manifold end sections 89 and 91 to the individual two fuel meters 57, respectively, of the hydraulic subassembly. A side view of the subassembly module of FIG. 6 is shown in FIG. 7, and more clearly shows the design, in this example, of the manifold 77.

Figure 7:
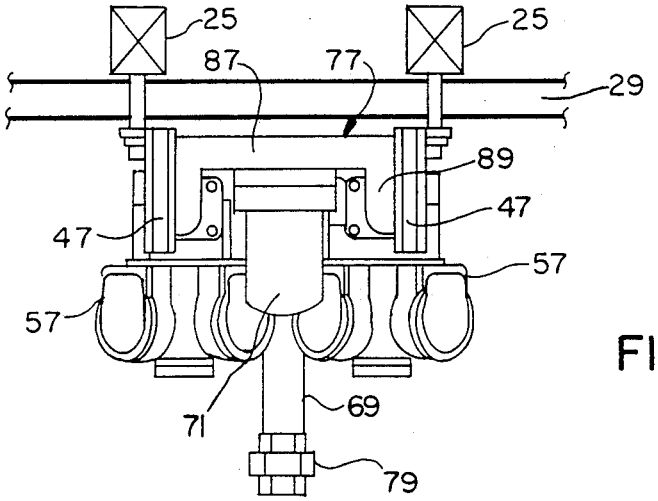
FIG. 7 is a partial cut-away front elevational view of the embodiment of the invention of FIG. 5.
Figure 8:
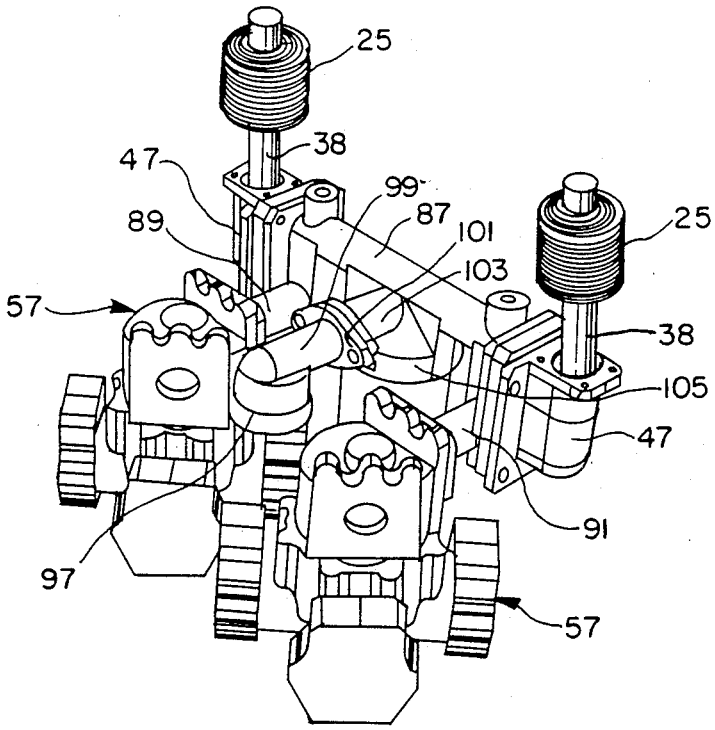
FIG. 8 is a floating isometric back view of portions of the embodiment of FIG. 7 looking downward at 45° from the right.

FIG. 8 shows a floating isometric drawing of the subassembly of FIGS. 5 through 7, as viewed from the rear or back side. A containment core 38 is connected between its associated coil 25, through the air gap 29, to the valve body 47. Valve control rods 35 are enclosed within the containment core tubes 38. The other end of the fuel inlet pipe or tube 69, FIG. 7 is adapted for connection to the manifold inlet coupling 97. Fuel is delivered from coupling 97 to manifold inlet 103. Filter base 105 receives a filter 71. As previously described, filtered fuel from the filter 71 is then delivered via the manifold inlet tube 87 to the valve bodies 47, with outlet tubes 89 and 91 of the manifold 87 being connected to individual ones of the flow meters 57, for delivering fuel thereto from their associated valve bodies 47. Note that in this example, the fuel meters are Gilbarco part Nos. PA024TC10 (manufactured by Gilbarco Inc., Greensboro, N.C.).

Figure 9:
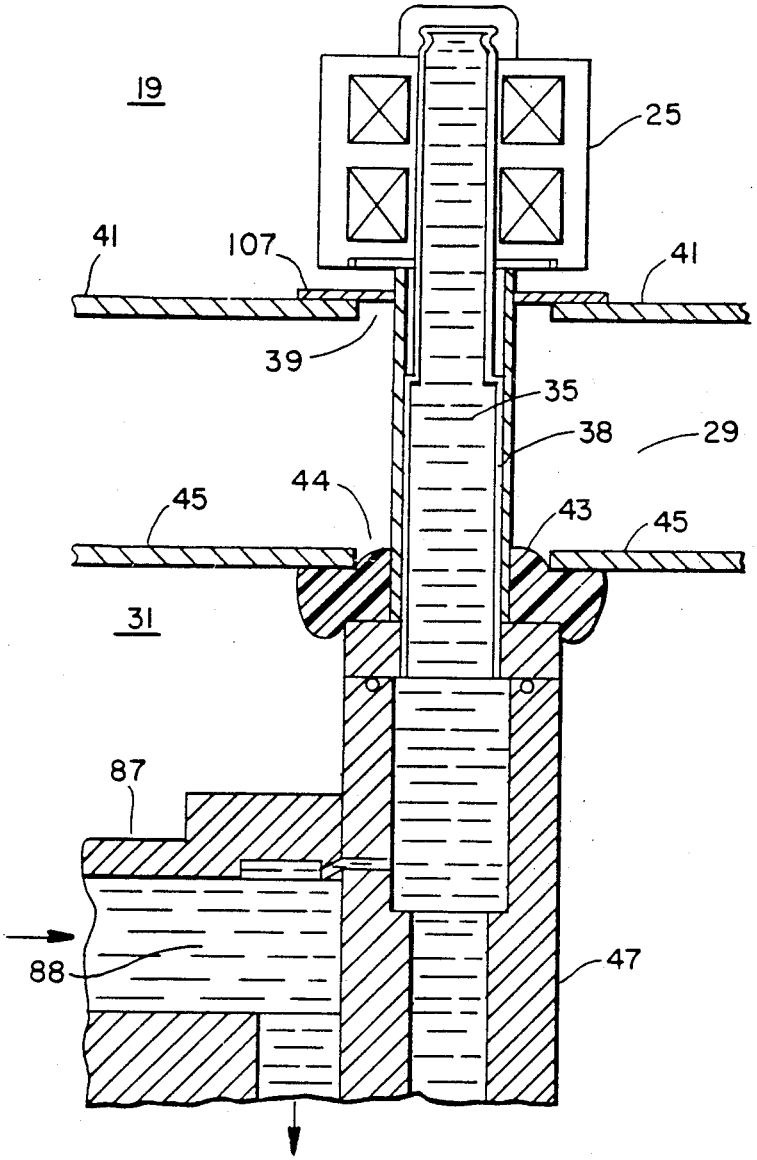
FIG. 9 is a cross-sectional view of a mounting arrangement between a valve coil located in a safe or unclassified zone, and an associated two-stage valve body located in a hazardous or classified zone, for one embodiment of the invention.

In FIG. 9, a cutaway and partial sectional view is shown of one embodiment of the invention for connecting a valve coil or solenoid winding 25 in an unclassified zone 19, through an air gap 29, to a valve body 47 in a classified or hazardous area 31. In this example, a washer 107 is resting on the inside surface of the wall member 41 of the upper enclosure 19, about the hole 39. The washer is held in place by gravity. The valve extension tube or containment core 38 passes through the washer 107, through the air gap 29, and through the hole 44 in the wall 45 for the lower enclosure 31. The sealing member 44, previously mentioned, is in this example an elastomeric seal in the form of a washer-like disk surrounding the inside surface of the walls 45 of lower enclosure 31 about the hole 44, as shown. The sealing member 43 is sandwiched between the valve body 47 and the inside surface of the walls 45 of the lower enclosure 31. The containment core 38 passes through the sealing member 43, and into valve body 47, with sealing member 43 providing a relatively tight seal about the valve extension or containment core 38. In this manner gasoline fumes, and liquid, are substantially prevented from escaping into the area of the air gap 29. This feature alone is recognized by some safety authorities as a suitable vapor barrier, making the air gap unnecessary. A substantial feature of this invention is the combination of the solid partition and the air gap as redundant vapor barriers between the hazardous and safe zones 19 and 31, respectively. Note that any fumes that might escape would tend to travel through the air gap and be expelled into the atmosphere. Also, conventional mounting apparatus (not shown) are used to secure the solenoid winding or valve coil 25 to the containment core 38, and similarly to rigidly secure the hydraulic subassembly in place in the lower enclosure 31. Note that the pulser rods 61 are sealed with a conventional seal such as a lip seal 46.

Figure 10:
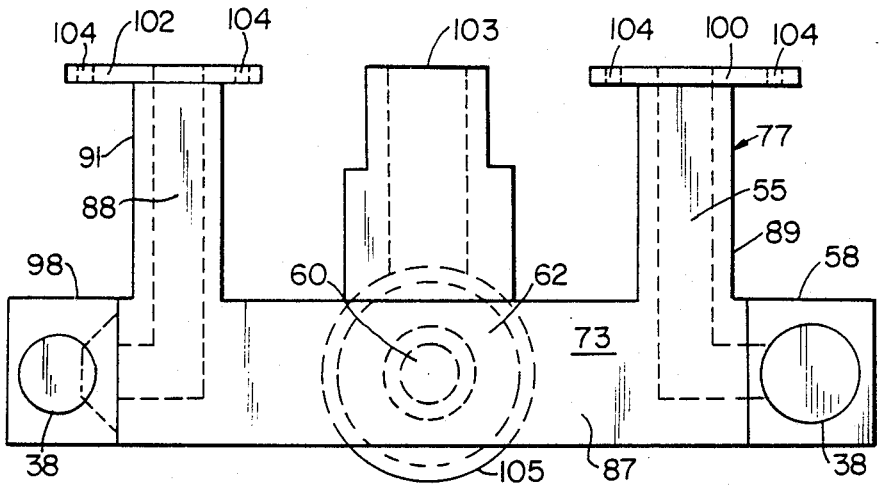
FIG. 10 is a top plan view of a manifold of one embodiment of the invention.
Figure 11:
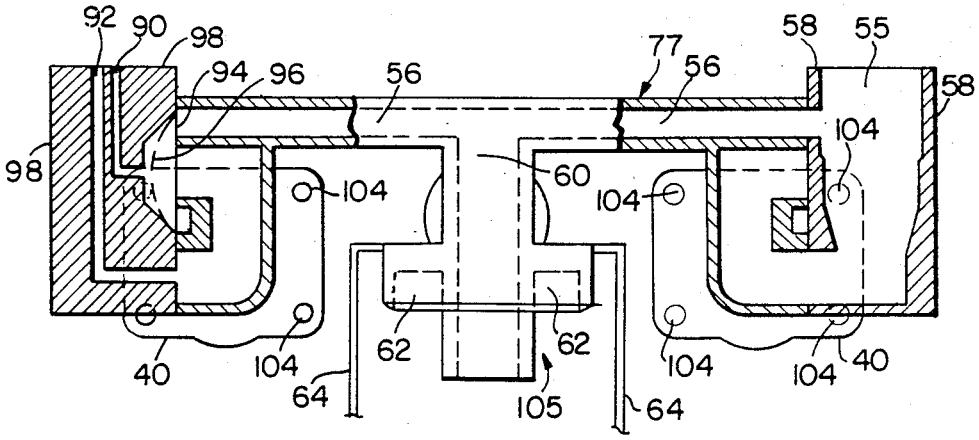
FIG. 11 is an end elevation partial sectional view of the manifold of FIG. 10.

As previously mentioned many different valves can be used in the present invention. For example, valve body 47 and valve coil 25 can be either a two-stage valve or a proportional valve, with each being directly and totally interchangeable onto manifold assembly 77. For example, in one embodiment of the invention in FIG. 10, showing a top plan view of manifold assembly 77, a valve body 58 on the right-hand side is for a proportional valve, and a valve body 98 on the left-hand side for a two-stage valve. In FIG. 11, the end elevational view of the manifold assembly 77 more clearly shows the valve bodies in section, with the two-stage valve body 98 including a low-pressure control passage 92 and a high-pressure control passage 90. A diaphragm 94 is shown in the closed position for the valve 98, and also shown in phantom as diaphragm 96 in the open condition for the valve 98. The top portion of the two-stage valve body 98 connects to other portions of the two-stage valve, as does the top portion of the proportional valve body 58 connect to other mechanisms of the latter.

With further reference to FIGS. 10 and 11, the manifold 73 includes a manifold inlet 103 for receiving fuel and passing it to an annulus 62, for delivery to a filter 71 (see FIG. 7). The filter return passage 60 provides a return path for filtered fuel from filter 71. As shown in FIG. 11, the filtered fuel is conveyed by a passageway 56, fed by fuel from passageway 60, to the valve bodies 58 and 98. In this example, one valve body is shown as a valve body 58 for a proportional valve, and the other valve body is shown as a valve body 98 for a two-stage valve, as previously mentioned. Also, with further reference to FIG. 10, the manifold 73 includes connecting arms 89 and 91 having outlet port flanges 100 and 102, respectively, for connection to respective meters 57. Bolt holes 104 are provided in this example for securing the mounting flanges 100, 102 to their respective meters 57. Lastly, the filter base 105 has a cylindrical splash guard 64 for containing therein the splashing of fuel upon removal of a filter 71 from the filter assembly 105.

As shown above, the various preferred embodiments of the invention permit a valve mechanism to be partially located in two zones, that is to have its electrical portions located in an unclassified or safe zone, and its hydraulic or fuel carrying portions located a classified or hazardous zone, as shown, and to have them separated by an air gap. Also, through use of an integrated subassembly for a pair of fuel meters, and their respective valve mechanisms, with connections between the electrical and fuel carrying portions being mechanically or hydraulically made through an air gap or vapor barrier, the need for explosion proof housings or intrinsically safe apparatus is eliminated. In this manner, a safer dispenser housing is provided at a lower cost.

Although various preferred embodiments of the invention are shown above for purposes of illustration, they are not meant to be limiting, and variations or modifications thereof may occur to those of ordinary skill in the art, which modifications are meant to be covered by the spirit and scope of the claims appended hereto.

What We claim Is:

1. A fuel dispenser system for substantially eliminating explosion proof housings for electrical apparatus, and/or intrinsically safe electrical apparatus requirements, comprising:

a housing, first partition means for partitioning a portion of said housing into a safe or unclassified zone within a first enclosure for containing electrical devices, including electrical elements of electromechanical devices;

second partition means for partitioning another portion of said housing into a hazardous zone within a second enclosure, for containing mechanical apparatus, including the mechanical elements associated with said electromechanical devices;

air gap means for providing an air gap between said first and second enclosures, for isolating fuel vapor and fumes that may develop within said second enclosure from said first enclosure to provide a first vapor barrier; and first bifurcated electromechanical valve means including an electrical control portion mounted within said first enclosure, a valve body including mechanical control means for controlling the flow of fuel therethrough, mounted within said second enclosure, and mechanical linkage means connected from said electrical control portion, through said air gap, to said mechanical control means, said electrical control portion being operable for positioning said mechanical linkage means to selectively operate said mechanical control means for establishing a desired flow rate of fuel through said valve body.

2. The fuel dispenser of claim 1, wherein said first bifurcated electromechanical valve means consists of a solenoid operated valve including a solenoid winding for said electrical control portion, a plunger and seat for said mechanical control means, and a control rod for said mechanical linkage means, said control rod having one end partially within a core of said solenoid winding, its other end operating a flow control mechanism in said valve body, and said valve body including an inlet port and an outlet port for receiving and discharging fuel, respectively.

3. The fuel dispenser of claim 2, further including:

first bifurcated volume flow measurement means including an electrical pulser mounted within said first enclosure, a flow meter mounted within said second enclosure, and a pulser rod connected from said flow meter through said air gap, to said pulser, said flow meter including an inlet port for receiving fuel, and an outlet port for discharging fuel; and means for connecting said flow meter in series with said valve body relative to the flow of fuel therethrough.

4. The fuel dispenser of claim 3, wherein said connecting means includes a manifold having a first inlet port for receiving fuel, a first outlet port connected to said inlet port of said valve body, a second inlet port for connection to said outlet port of said valve body, and a second outlet port connected to said inlet port of said fuel meter.

5. The fuel dispenser of claim 3, further including:

a second bifurcated electromechanical valve means substantially identical to said first bifurcated electromechanical valve means;

a second bifurcated volume flow measurement means substantially identical to said first bifurcated volume flow measurement means; and said connecting means further including means for connecting said flow meter of said second bifurcated volume flow measurement means in series with said valve body of said second bifurcated electromechanical valve means.

6. The fuel dispenser of claim 5, wherein said connecting means comprises a manifold including a first inlet port for receiving fuel, first and second outlet ports for connection to said inlet ports of said valve bodies of said first and second valve means, respectively, second and third inlet ports for connection to said outlet ports of said valve bodies of said first and second valve means, respectively, third and fourth outlet ports for connection to said inlet ports of said first and second flow meters, respectively.

7. The fuel dispenser of claim 6, wherein said manifold further includes a filter port for connection to a filter for filtering fuel prior to delivery to said valve bodies of said first and second bifurcated electromechanical valve means.

8. The fuel dispenser of claim 2, further including sealing means for substantially preventing the leakage of fuel fumes from a hole in a wall of said second enclosure through which said control rod enters the former.

9. The fuel dispenser of claim 8, wherein said sealing means includes an elastomeric seal.

10. The fuel dispenser of claim 9, wherein said control rod is enclosed within a containment core, and said elastomeric seal substantially fills the space between said containment core and said hole.

11. The fuel dispenser of claim 8, further including sealing means for preventing the leakage of fuel fumes from hole in a wall of said second enclosure through which a pulser rod enters said second enclosure.

12. The fuel dispenser of claim 11, wherein said sealing means includes an elastomeric seal about said holes.

13. The fuel dispenser of claim 5, further including sealing means for substantially preventing the leakage of gasoline fumes from holes through a wall of said second enclosure through which said control rods and said pulser rods enter said second enclosure.

14. The fuel dispenser of claim 13, wherein said sealing means includes elastomeric seals.

15. The fuel dispenser of claim 1, further including said second partition as a solid partition between said first and second enclosures, with sealing means for sealing said mechanical linkage means passing through a hole therethrough, to provide a second vapor barrier.

16. A fuel dispenser system for substantially eliminating explosion proof housings for electrical apparatus comprising:

a housing including a first enclosure for containing electrical devices, a second enclosure for containing mechanical apparatus, said first and second enclosures being separated from one another by an air gap for providing a first vapor barrier, whereby the area within said first enclosure provides a safe area, and the area within said second enclosure is a hazardous area;

first and second bifurcated electromechanical valve means, each including electrical means mounted within said first enclosure for operating said valve means, a valve body mounted within said second enclosure, said valve bodies each including mechanical control means for controlling the flow of fuel therethrough, an inlet port, and an outlet port, and mechanical linkage means connected from said electrical control portion through said air gap to said mechanical control means;

first and second bifurcated volume flow measurement means, each including an electrical pulser mounted within said first enclosure, a flow meter including inlet and outlet ports mounted within said second enclosure and a pulser rod connected from said flow meter, through said air gap, to said pulser; and manifold means for connecting the flow meter and valve body of said first flow measurement means and first valve means, respectively, into a first series fluid flow circuit, and the flow meter and valve body of said second flow measurement means and second valve means, respectively, into a second series fluid flow circuit, thereby forming a hydraulic module subassembly for said dispenser.

17. The fuel dispenser system of claim 16, wherein said manifold means includes:

first inlet and outlet ports for connection to said outlet and inlet ports, respectively, of said valve body of said first valve means;

second inlet and outlet ports for connection to said outlet and inlet ports, respectively, of said valve body of said second valve means;

a third outlet port for connection to said inlet port of said first fuel meter;

a fourth outlet port for connection to said inlet port of said second fuel meter; and a third inlet port for connection to a source of fuel.

18. The fuel dispenser system of claim 17, wherein said manifold means further includes a filter port for connection to a filter for filtering fuel received at said third inlet port before discharge from said first and second outlet ports.

19. The fuel dispenser of claim 16, further including a solid partition for providing a second vapor barrier between said first and second enclosures with through hole means for passing through said mechanical linkage means.

20. The fuel dispenser system of claim 16, further including sealing means for substantially preventing the escape of gasoline fumes from said second enclosure through holes in a wall thereof through which said pulser rods and said mechanical linkages pass thereinto from said air gap.

21. The fuel dispenser system of claim 16, wherein said first and second bifurcated electromechanical valve means each include a solenoid winding for said electrical means, a plunger and seat for said mechanical control means, and a control rod for said mechanical linkage means.

22. The fuel dispenser system of claim 21, wherein said first and second bifurcated electromechanical valve means each include tubing means enclosing said control rods, respectively, between associated ones of said solenoid windings and valve bodies.

23. The fuel dispenser system of claim 22, further including sealing means for substantially preventing the escape of gasoline fumes from said second enclosure through holes in a wall thereof, through which said pulser rods and tubing means enclosing control rods pass into said second enclosure from said air gap.

24. The fuel dispenser system of claim 23, wherein said sealing means includes elastomeric seals.

25. In a fuel dispenser, a method for valve control through an air gap, comprising the steps of:

(A) partitioning a housing into a first enclosure providing a safe unclassified zone, and a second enclosure providing a hazardous classified zone;

(B) providing an air gap between said first and second enclosures, for trapping any fuel vapor and fumes escaping from said second enclosure to prevent entry thereof into said first enclosure;

(C) bifurcating an electromechanical valve into an electrical control portion, and a valve body including a valve mechanical control mechanism;

(D) mounting said electrical control portion of said valve in said first enclosure;

(E) mounting said valve body of said valve in said second enclosure; and (F) mechanically linking said electrical control portion through said air gap to said valve mechanical control mechanism, for controlling said valve in a manner isolating the electrical control portion from the fuel handling area of said dispenser.

26. The method of claim 25, further including the step of providing a substantially solid partition between said first and second enclosures with sealed through holes for a mechanical linkage between said electrical control portion and mechanical control mechanism of said valve.

27. The method of claim 25, further including the step of venting said air gap into the atmosphere, for permitting any fuel fumes and vapors entering said air gap to evaporate into the atmosphere.

* * * * *

UNITED STATES PATENT AND TRADEMARK OFFICE

CERTIFICATE OF CORRECTION

PATENT NO. : 4,986,445

DATED : January 22, 1991

INVENTOR(S) : Harold R. Young, John S. McSpadden, James R. McMordie, and Leon B. Smith It is certified that error appears in the above-identified patent and that said Letters Patent is hereby corrected as shown below:

Column 4, line 37 change "exists" to --exits--; and line 52 change "46" to --43 and 46--.

Column 6, line 30 change "44" to --43--.

Signed and Sealed this

Twenty-ninth Day of September, 1992

*Attest:*

DOUGLAS B. COMER

*Attesting Officer*

*Acting Commissioner of Patents and Trademarks*